United States Patent [19]

Dutton

[11] Patent Number: 5,052,607

[45] Date of Patent: Oct. 1, 1991

[54] FASTENER DRIVING TOOL WITH POINTING DEVICE

[75] Inventor: Donald M. Dutton, Milton Keynes, England

[73] Assignee: Duo-Fast Corporation, Franklin Park, Ill.

[21] Appl. No.: 667,543

[22] Filed: Mar. 11, 1991

[30] Foreign Application Priority Data

Mar. 30, 1990 [GB] United Kingdom ..... 9007173

[51] Int. Cl.[5] ..... A41H 37/10

[52] U.S. Cl. ..... 227/107; 227/55; 227/119

[58] Field of Search ..... 227/18, 51, 55, 60, 227/119, 107

[56] References Cited

U.S. PATENT DOCUMENTS

| | | | |
|---|---|---|---|
| 2,377,263 | 5/1945 | Peterson | 227/18 |
| 3,670,941 | 6/1972 | Grinnell et al. | 227/119 |
| 3,964,661 | 6/1976 | Schmidt et al. | 227/18 |
| 4,605,150 | 8/1986 | Ikehara | 227/18 |
| 4,723,357 | 2/1988 | Suyama et al. | 227/119 |
| 4,765,524 | 8/1988 | Yoshieda | 227/119 |

*Primary Examiner*—Mark Rosenbaum
*Assistant Examiner*—Scott A. Smith
*Attorney, Agent, or Firm*—Mason, Kolehmainen, Rathburn & Wyss

[57] ABSTRACT

A fastener driving tool includes a pointing device permitting the tool to be positioned against a workpiece so that a fastener is driven precisely at a target point. The tool includes a body with a nose portion in which is a fastener drive track. A foot assembly moves from a rest position toward the tool body to a drive position when the tool is pressed against the workpiece. In the rest position, the pointing device is aligned with the drive track and is adjacent the workpiece. When the tool is moved to the drive position, the pointing device is retracted, the nose portion approaches the workpiece, a safety mechanism is operated and a fastener is driven into the selected target point.

6 Claims, 2 Drawing Sheets

FASTENER DRIVING TOOL WITH POINTING DEVICE

FIELD OF THE INVENTION

The present invention relates to fastener driving tools and more particularly to a fastener driving tool with a pointing device permitting a fastener to be driven into a workpiece at a precise location.

DESCRIPTION OF THE PRIOR ART

Fastener driving tools are widely used in many diverse applications for driving fasteners into many different types of workpieces. A typical fastener driving tool includes a tool body enclosing a power system, such as a pneumatic system, for moving a fastener, for example a nail, along a drive track through a nose portion of the body and into a workpiece. The tool may include a trigger for initiating a drive stroke and a safety for enabling the tool to operate only when the tool is pressed against a workpiece.

When a fastener is driven, it enters the workpiece at a location aligned with the drive track in the nose portion of the tool. With known fastener driving tools, the point at which the fastener is to be driven cannot be precisely selected. When an element of the tool, such as workpiece contacting portion of the tool safety, is placed against the workpiece, the nose portion of the tool is spaced away from the workpiece and can be positioned only approximately. For some uses of fastener driving tools, approximately fastener positioning is satisfactory. However, more exact positioning is necessary for other uses, such as when a fastener must be driven precisely through a hole in a hard, rigid metal object.

Past attempts to solve this problem have not been successful. One approach is to shape or mark the workpiece contacting portion of the tool to make it easier to align the fastener drive tack with a selected point on the workpiece. This approach can improve fastener driving accuracy, but is not sufficiently precise. Another attempted solution to the problem is to use a guide or gauge structure to locate the tool with respect to a reference location such as an edge of a workpiece. While satisfactory for some applications, this solution is only useful when the fasteners are to be driven a fixed distance from a uniform reference location.

SUMMARY OF THE INVENTION

Among the objects of the present invention are to provide a fastener driving tool that can drive a fastener into a precisely selected point on a workpiece; to provide a tool in which fastener positioning is more accurate than has been possible in the past; to provide a tool that can be used to drive fasteners in precise positions in many different applications and orientations without the necessity to rely on reference locations near the point where the fasteners is to be driven; to provide a tool having a pointing device that is aligned with the fastener drive track yet which does not obstruct or interfere with the fastener drive stroke; to provide a tool in which an accurate fastener positioning system is integrated with the safety of the tool; and to provide a fastener driving tool overcoming problems experienced with tools used in the past.

In brief, the objects and advantages of the invention are achieved by providing a fastener driving tool for driving a fastener into a workpiece and including a tool body defining a nose portion and a fastener drive track extending through the nose portion. A driver blade moves in the drive track in a fastener driving stroke. A foot assembly mounted on the tool body has a contact portion adapted to be placed against the workpiece. A slide structure mounts the foot assembly for reciprocal movement toward and away from the tool body in the direction of the fastener driving stroke between a rest position and a drive position. A spring system normally holds the foot assembly in the rest position in which the tool body is spaced from the workpiece and permits the tool body to move relative to the foot assembly to the drive position in which the nose portion is adjacent the workpiece. The fastener driving tool is characterized by a pointing member carried by the foot assembly and normally disposed in an aim position in alignment with the drive track between the nose portion and the contact portion. Means are responsive to relative movement of the foot assembly from the rest position to the drive position for withdrawing the pointing member away from the aim position to a retracted position clear of the nose portion.

BRIEF DESCRIPTION OF THE DRAWINGS

The present invention together with the above and other objects and advantages may best be understood from the following detailed description of the embodiment of the invention illustrated in the drawings, wherein.

DETAILED DESCRIPTION OF THE PREFERRED EMBODIMENT

Figure 1:
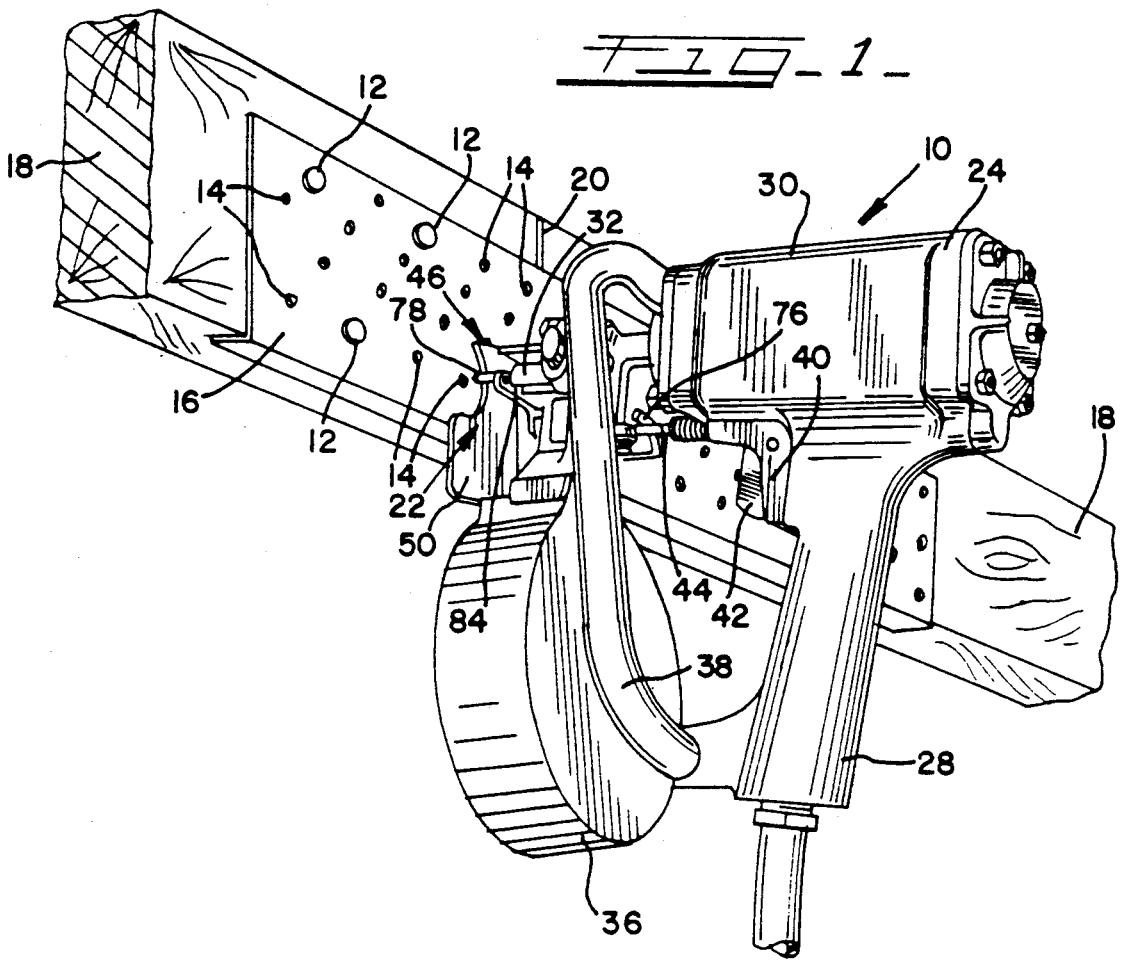
FIG. 1 is a perspective view of a fastener driving tool embodying the present invention used for attaching a perforated metal splicing plate to the butted ends of a pair of structural timbers.

Referring now to the drawings, FIG. 1 illustrates a fastener driving tool generally designated as 10 and constructed in accordance with the principles of the present invention. Fastener driving tool incorporating the principles of the present invention may take many forms and be used for many purposes. As seen in FIG. 1, the tool 10 is employed to drive fasteners 12 into holes 14 in a perforated splicing plate 16 used to join a pair of structural wooden timbers 18 having ends butted at a seam 20. The thickness and strength of the plate 16 makes it necessary for the fasteners 12 to be driven precisely through the centers of the holes 14 in order to avoid interference between the plate 16 and the fasteners 12 as they are driven into the timbers 18. When the tool 10 is used for repair of existing structures, it may be necessary to use the tool in confined spaces lacking good illumination. Yet, even under such adverse circumstances, precise positioning of the driven fasteners 12 is necessary. In order to permit each fastener to be driven into an exact target point, the tool 10 is provided with a pointing system generally designated as 22.

Figure 4:
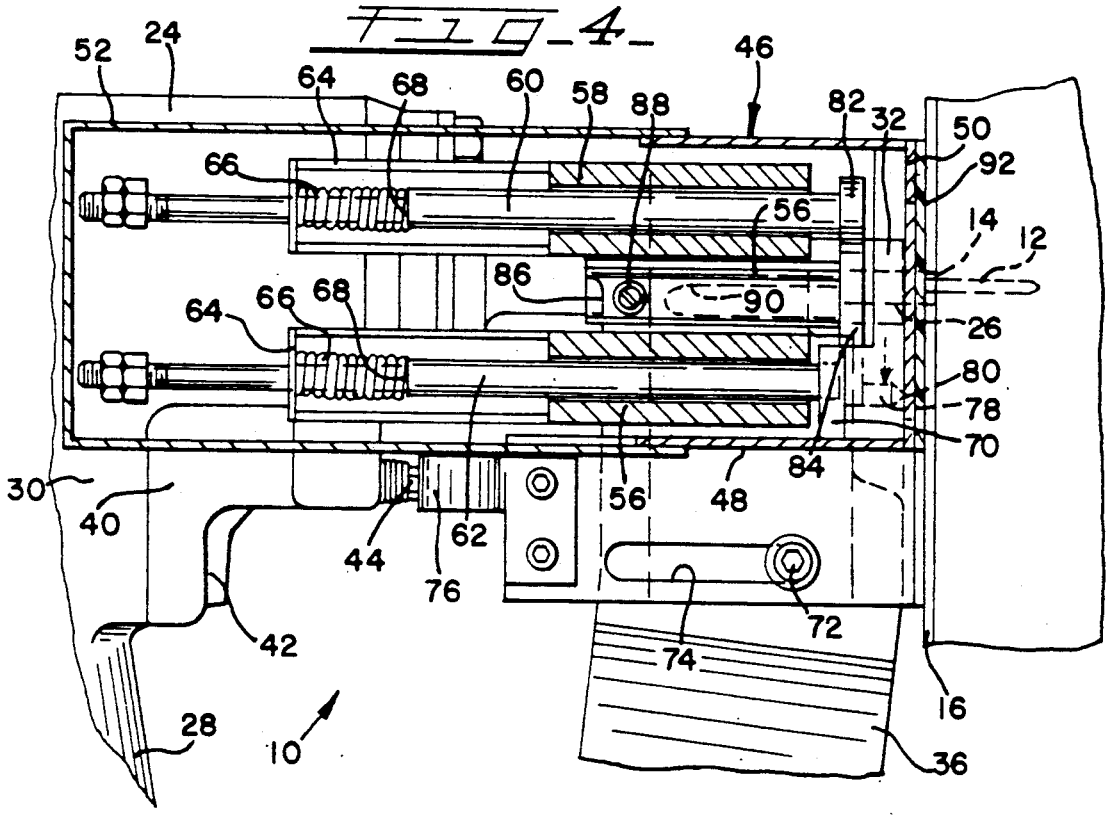
FIG. 4 is a view similar to FIG. 3 showing the tool at the conclusion of a fastener driving stroke.

Tool 10 is in many respects of known construction and a description of all of its details is not necessary to an understanding of the present invention. The tool 10 includes a tool body 24 enclosing a pneumatic drive system for moving a fastener driver blade 26 (FIG. 4) in a drive stroke. Body 24 includes a handle portion 28 and a head portion 30 upon which is supported a nose portion 32. A fastener drive track 34 is defined within the nose portion 32. A magazine 36 carries a supply of fasteners 12 that are presented into the drive track 34. The tool 10 may be gripped with two hands by using the handle 28 and a grip bar 38. A trigger and safety mechanism 40 controls the operation of the tool 10. When a trigger 42 is pressed and when a safety rob 44 is advanced into the assembly 40, a fastener drive stroke is initiated. During the drive stroke, the driver blade 26 moves through the drive track to drive a fastener 12 from its initial position indicated in FIG. 5 along the drive track 34 and into workpiece 18 as seen in FIG. 4

Figure 5:
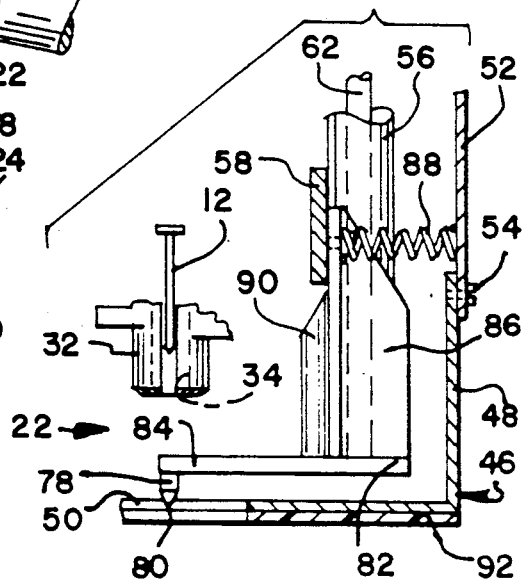
FIG. 5 is a fragmentary cross sectional view of the tool taken along the line 5—5 of FIG. 3.
Figure 3:
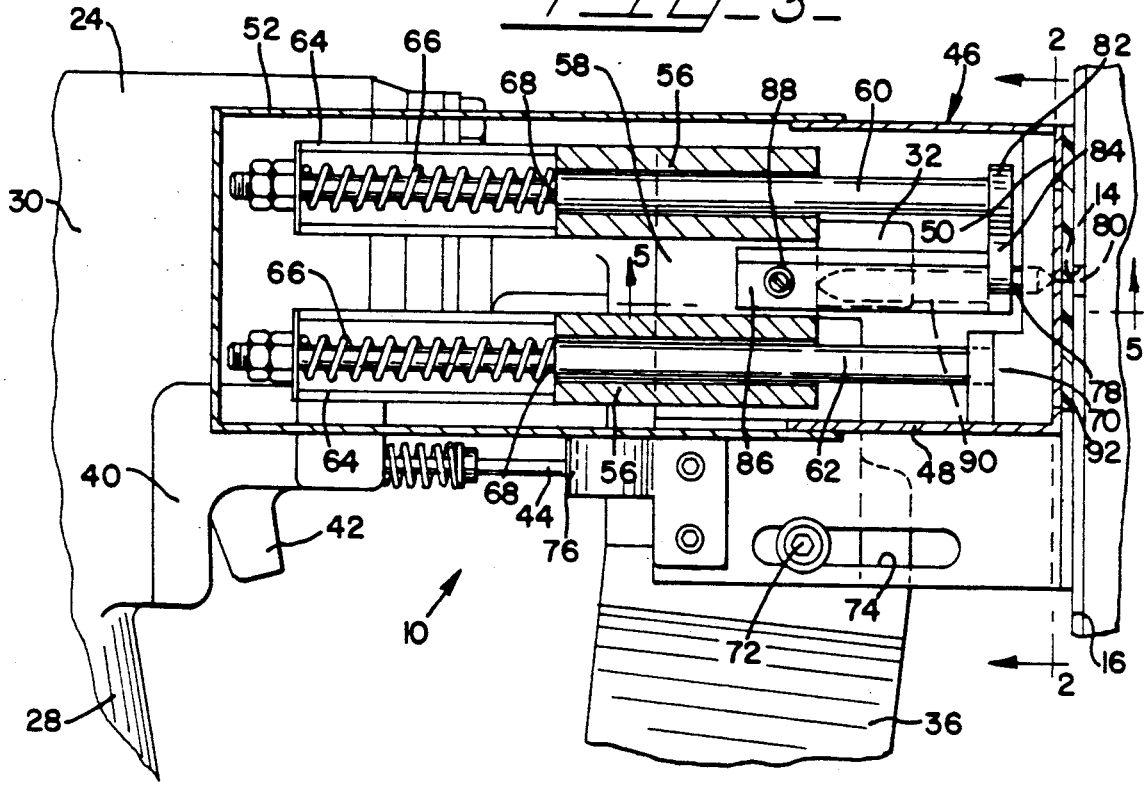
FIG. 3 is a cross sectional view of the tool taken along the line 3—3 of FIG. 2 showing the tool in contact with a workpiece prior to a fastener driving stroke.

Pointing system 22 is carried by a foot assembly 46 mounted for reciprocal sliding movement on the tool body 24 near the nose portion 32. The foot assembly 46 includes a housing 48 with a sole plate 50 that is positioned upon and then pressed against the workpiece as seen in FIGS. 3–5. A cover 52 is attached to the housing 48 by fasteners 54. The foot assembly 46 is mounted for movement relative to the tool body 24 by a slide system including a pair of tubular supports 56 fixed to a support plate 58 that is in turn fixed to the tool body 24. A pair of slide rods 60 and 62 are received in the tubular supports 56. Each tubular support carries an extension 64 for capturing springs 66 held in compression against shoulders 68 on the rods 60 and 62. The end of the rod 60 is fixed to an abutment 70 fixed to the housing 48. The support plate 58 carries a screw 72 that is slideably received in a slot 74 in the housing 48 to help in maintaining proper alignment of the foot assembly 46 relative to the tool body 24.

The springs 64 normally holds the foot assembly 46 away from the tool body 24 in a standby or rest position (FIGS. 1, 3 and 5). When the tool 10 is pressed against the workpiece (FIG. 4), the springs compress to permit the foot assembly 46 to move toward the tool body 24 to a fastener drive position in which the nose portion 32 is close to or against the workpiece. A safety operating arm 76 attached to the foot assembly housing 48 advances the safety rod 44 into the mechanism 40 as the foot assembly 46 moves relative to the tool body 24 from the rest position to the drive position. This enables the tool to operate in a drive stroke when the trigger 42 is pressed. After a drive stroke, when the tool body 24 is moved away from the workpiece, springs 64 force the foot assembly away from the tool body 24 to the rest position ready for a subsequent fastener driving operation.

Figure 2:
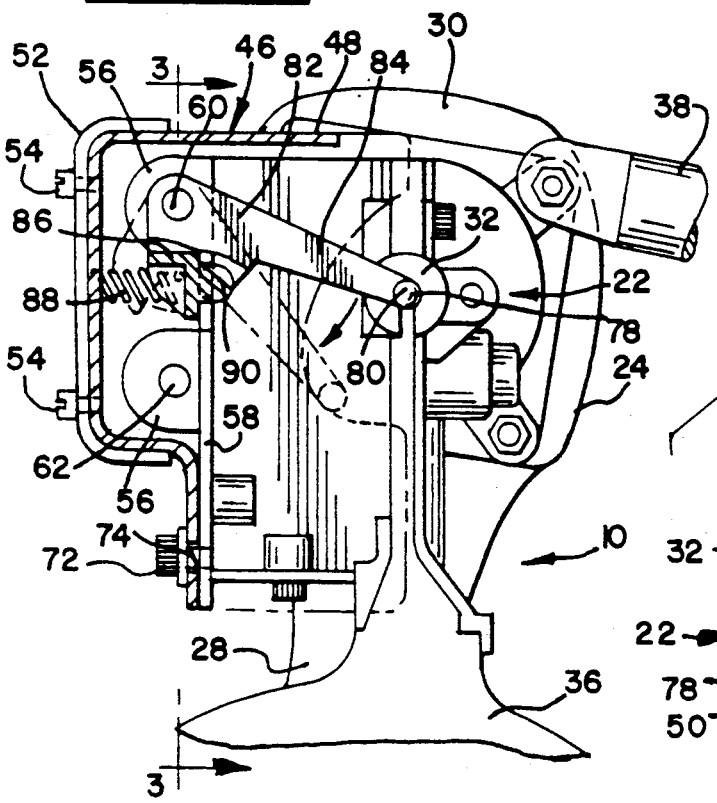
FIG. 2 is a cross sectional view of the tool taken along the line 2—2 of FIG. 3.

Precise location of the target point in which a fastener 12 is driven is made possible by the pointing system 22 including a pointer member 78 that can be accurately aligned with the target point. As best seen in FIGS. 2 and 5, the pointer member 78 is aligned with the drive track 34 in the rest position of the foot assembly, and lies between the end of the nose portion 32 and the workpiece. To assist in precise placement of the tool, the member 78 is elongated and has a point 80 pointed directly at the target area. To increase the accuracy of fastener placement in areas of limited illumination, the pointer member is visually prominent. For example, in the preferred embodiment, the pointer member 78 is bright and glossy stainless steel while the nearby components of the tool 10 have a flat, black finish. Unlike the nose portion 32 which is spaced away from the workpiece in the rest position, the pointer member 78 is positioned very close to the workpiece. Thus, the pointer member can be lined up precisely with a target point, for example the center of a hole 14, to assure that when the tool is pressed against the workpiece, the nose portion 32 and the drive track 34 are located at the desired position over the selected target area.

In the rest position, the pointer member 78 lies between the nose portion 30 and the workpiece. As the tool body 24 moves relatives to the foot assembly to the drive position, the pointer member 78 is withdrawn to a retracted position so that the nose portion 30 can approach the workpiece without interference with the pointer member.

A pivot bracket 82 is secured to the end of the slide rod 62 and includes an arm 84 carrying the pointer member. Rod 62 is able to rotate within the corresponding tubular support 56. An angle member 86 extends from the bracket 82 to the region of the support plate 58. In the rest position, a spring 88 compressed between the cover 52 and the bracket 82 holds the bracket 82 with the pointer member 78 in an aim position over the target point (FIGS. 2, 3 and 5). As the foot assembly 46 moves relative to the tool body 24 from the rest position to the drive position, a cam member 90 fixed to the angle member 86 engages the adjacent part of the support plate 58 and causes the bracket 82 to pivot to the retracted position. As seen in broken lines in FIG. 2, in this position the arm 84 and pointer member 78 are clear of the path of movement of the nose portion 32.

The sequence of operations during driving of a fastener 12 begins when the sole plate 50 is placed into contact with the workpiece. The tool body 24 and foot assembly 46 are initially in the rest position, and the pointer member 78 is in the aim position. The pointer 80 is visually aligned with the target point into which a fastener 12 is to be driven.

When the tool 10 is precisely aimed, the tool body 24 is moved toward the workpiece to compress the slide springs 66 and advance the tool body 24 to the drive position. A friction pad 92 of rubber or the like on the sole plate 50 holds the tool 10 in the precisely aimed position during this movement. In the first segment of the movement toward the drive position, cam member 90 engages support plate 58 to retract the arm 84 and pointer member 78. Then the nose portion continues to move toward the workpiece, remaining in precise alignment with the selected target point. When the drive position is reached, the safety rod 44 is advanced into the mechanism 40 and a drive stroke is commenced when the trigger 42 is pressed. Some safety mechanisms may permit the trigger 42 to be pressed while the tool is in the rest position so that a drive stroke is initiated by the safety rod 44.

After a fastener 12 is driven, the tool 10 is withdrawn from the workpiece. Slide springs 66 return the foot assembly 46 and tool body 24 to the rest position. Spring 88 pivots the bracket 82 to return the arm 84 and pointer member 78 to the aim position, ready for another fastener driving operation.

What is claimed is:

1. A fastener driving tool for driving a fastener into a workpiece, said fastener driving tool comprising:

a tool body defining a nose portion and a fastener drive track extending through said nose portion;

a driver blade movable in said drive track in a fastener driving stroke;

a foot assembly mounted on said tool body and having a contact portion adapted to be placed against the workpiece;

slide means mounting said foot assembly for reciprocal movement toward and away from said tool body in the direction of the fastener driving stroke between a rest position and a drive position;

spring means normally holding said foot assembly in the rest position in which said tool body is spaced from the workpiece and permitting said tool body to move relative to the foot assembly to the drive position in which said nose position is adjacent the workpiece;

the fastener driving tool being characterized by:

a pointing member carried by said foot assembly and normally disposed in an aim position in alignment with said drive track between said nose portion and said contact portion; and means responsive to relative movement of said foot assembly from said rest position to said drive position for withdrawing said pointing member away from said aim position to a retracted position clear of said nose portion.

2. The fastener driving tool of claim 1, said foot assembly including a pivot arm movable in a direction perpendicular to the direction of the fastener driving stroke, said pointing member being mounted on said pivot arm.

3. The fastener driving tool of claim 2, said responsive means including a cam.

4. The fastener driving tool of claim 1, said tool further comprising a safety assembly for controlling the initiation of a drive stroke, and said foot assembly including a safety operating member for enabling said safety assembly in response to relative movement of said foot assembly from said rest position to said drive position.

5. The fastener driving tool of claim 1, said pointing member comprising an elongated and pointed element with its point directed toward the workpiece.

6. The fastener driving tool of claim 1, said pointing member having a surface that contrasts visually with said foot assembly and nose portion.

* * * * *